United States Patent [19]

Heng et al.

[11] Patent Number: 4,722,699

[45] Date of Patent: Feb. 2, 1988

[54] EMBEDDED WIRE-STRIPPING CONNECTOR FOR ELECTRICAL EQUIPMENT

[75] Inventors: Jean-Paul Heng, Lyons; André Marmonier, Bron; Ariel Ruiz; Dominique Vial, both of Villeurbanne, all of France

[73] Assignee: CGEE Alsthom, Levallois-Perret, France

[21] Appl. No.: 879,773

[22] Filed: Jun. 27, 1986

[30] Foreign Application Priority Data

Jul. 2, 1985 [FR] France ..... 85 10083

[51] Int. Cl.[4] ..... H01R 4/24

[52] U.S. Cl. ..... 439/396; 439/401; 439/402

[58] Field of Search ..... 339/97 R, 98, 97 P, 339/99 R; 439/391, 395–408, 409

[56] References Cited

U.S. PATENT DOCUMENTS

| | | | |
|---|---|---|---|
| 3,812,449 | 5/1974 | Elm | 339/98 |
| 3,845,455 | 10/1974 | Shoemaker | 339/97 R |
| 4,037,906 | 7/1977 | Sayne | 339/107 |
| 4,452,501 | 6/1984 | Gladd et al. | 339/97 R X |
| 4,466,682 | 8/1984 | Susseau et al. | 339/97 R |
| 4,508,411 | 4/1985 | Hughes et al. | 339/99 R |

FOREIGN PATENT DOCUMENTS

| | | | |
|---|---|---|---|
| 2419594 | 10/1979 | France | 339/97 R |
| 2516711 | 5/1983 | France | 339/97 R |
| 197808 | 7/1978 | United Kingdom | 339/97 R |
| 2083297 | 3/1982 | United Kingdom | 339/97 R |

*Primary Examiner*—John McQuade

*Attorney, Agent, or Firm*—Sughrue, Mion, Zinn, Macpeak and Seas

[57] ABSTRACT

A connector for connecting sheathed electric wire (19) to a metal connector part (1) having a wire-stripping slot (2) and held fixedly in a housing in a body of insulating material (11) having a wire-passing opening running along the slot (2). The connector part includes a transverse cavity (10) disposed inside the housing, behind the slot (2) and facing the slot in such a manner as to serve as a fixed bearing point for an end piece (20) on the blade of a tool (17) which is used as a lever for inserting a wire into the slot and into the wire-passing opening by applying force thereto. The invention may be used to provide wire-stripping connections in the housings of electrical appliances.

9 Claims, 18 Drawing Figures

EMBEDDED WIRE-STRIPPING CONNECTOR FOR ELECTRICAL EQUIPMENT

The present invention relates to an embedded wire-stripping connector for electrical equipment, and to a tool for use with such a connector.

BACKGROUND OF THE INVENTION

Electrical equipment is often connected to individual wires having conductive cores sheathed in insulation by means of connections in which the cores of conductors to be connected are clamped between pairs of conductive parts by a screw device or by a spring mechanism. For the manufacturer, such connections suffer from the drawback of requiring several different components in order to provide a single connection, thereby requiring assembly operations which should be avoided as much as possible in order to reduce manufacturing costs, (e.g. assembling and screwing in screws for screw connections, or compressing springs prior to assembly for spring mechanisms, both of which operations are relatively difficult and are consequently potential sources of trouble).

Such connectors also suffer from the drawback for the user of requiring the ends of the wires to be stripped prior to connection therewith. It is common practice when making low-current electrical connections to use wire-stripping connectors which include a slotted metal connector part in which the edges of the slot are suitable for clamping against the core of an insulated electric wire once the wire has been inserted into the open end of the slot, with the sides of the slot cutting through the insulation while leaving the metal core practically undamaged.

Such wire-stripping connectors are suitable for making connections by means of special insertion tooling, e.g. by means of a machine in a factory, and this is conventional for multi-point connectors used in telecommunications, or for connectors whose shape and size are such as to enable wires to be connected with conventional tools such as a pair of pliers, as is the case with miniature connectors for use with telephone wires.

However, wire-stripping connectors for high current electrical apparatus, e.g. for junction blocks, cam switches, or relay switches, are not generally satisfactory when the connections are to be made on the housings containing said electrical apparatuses and when taking account of the constraints placed on said housings.

Because of the larger size of the wires, the insertion force must be increased relative to the above-mentioned low-current applications, and means are therefore required for amplifying the insertion force, which means often complicate the apparatus with which they are associated and generally also increase its bulk and make it more expensive.

In addition, the positions of connections on such housings, and the sizes of such housings, may vary widely depending on the specific applications, thereby making the solutions suggested above inapplicable. It thus appears that there is a need for a connector which mitigates the above drawbacks, which reduces the costs of manufacturing and assembling an installation, which are of reduced bulk, and which are easily adapted to different housings.

SUMMARY OF THE INVENTION

The present invention thus provides a wire-stripping connector for connection to at least one electric wire having a conductive core disposed in an insulating sheath, the connector comprising a metal connector part having at least one longitudinal core-clamping slot of elongate shape and opening out at one end to enable the wire to be inserted between the edges of the slot, said slot edges being arranged at said insertion end for cutting through the insulation without knicking the core, said connector part being fixedly retained in a housing in a body of insulating material having a wire-passing opening therethrough running along the slot, said connector including the improvement whereby said connector part includes a transverse cavity located behind the slot in said housing and open towards the slot in such a manner as to serve as a fixed bearing point for a bearing end piece provided at one end of the blade of a tool for use as a lever to thrust a wire into said slot, said tool blade having an intermediate zone for engaging a wire in the vicinity of the slot and for urging a wire substantially orthogonally into the slot and into the wire-passing opening when an external insertion thrust is exerted in the slot direction to the opposite end of the tool blade, the body of insulating material covering the connection part around said cavity to reinforce the cavity and to enable it to withstand pressure from the tool blade while a wire is being inserted in the slot.

Advantageously, the connection tool comprises a blade and a handle for manipulating the blade, the blade having a bearing end piece at its free end for engagement in the connector above the slot in a connector part which is to receive a wire, in such a manner as to press on said wire in the slot direction, said blade including two notches on its underside at suitable distances from its free end to enable it to apply pressure on a wire on either side of the slot and of the corresponding wire-passing opening without requiring the tool to enter into the slot or into the wire-passing opening.

BRIEF DESCRIPTION OF THE DRAWINGS

Embodiments of the invention are described by way of example with reference to the accompanying drawings, in which.

MORE DETAILED DESCRIPTION

Figure 1:
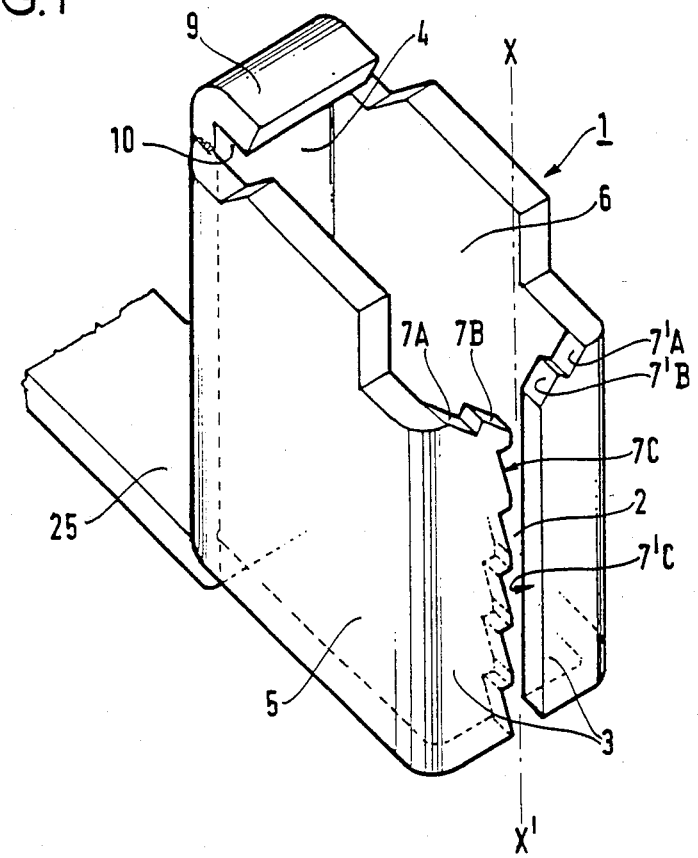
FIG. 1 is a perspective view of a connector part for a wire-stripping connector in accordance with the invention.

As mentioned above, a wire-stripping connector in accordance with the invention is intended for connecting one or more insulated electric wires to an electrical apparatus via a connector part such as the part 1 shown in FIG. 1. Connector parts of this kind are conventionally locked in a recess in a body made of insulating material which contains or at least partially covers said apparatus, which apparatus may be of any kind, running from a mere interconnection circuit, e.g. a junction block, to equipment built up from numerous components, including a contactor, a motor, electronic components, etc.

The connector part 1 is made of a metal which is a good conductor of electricity and is conventionally provided with a longitudinal slot 2 running along one of its walls 3, herein referred to as its front wall.

In a preferred embodiment, the connector part 1 is obtained by folding a metal blank which is cut out from a metal strip.

The connector part 1 comprises a main body of rectangular section which includes the front wall 3, a back wall 4 and two side walls 5 and 6. The front wall 3 comprises two parts which are separated by the longitudinal slot 2 and each of which is formed by an extension of a corresponding one of the side walls 5 and 6 folded inwardly at right angles from the end of the side wall. The front wall 3 is planar and the facing end edges of the two extensions which constitute the front wall 3 delimit the slot 2. These slot edges are designed to ensure firstly that the insulation sheathing an electrical conductor wire is cut transversely without knicking said wire core, and also to ensure that said core is clamped between the edges of the slot.

To this end, the edges of the slot 2 at the insertion end slope symmetrically towards each other on either side of a slot insertion axis XX', thereby providing guidance cam means 7A, 7'A followed by two slicing chamfers 7B and 7'B for cutting the insulation of the wires to be connected, which are followed, in turn, by two clamping strips 7C and 7'C for clamping the cores of wires connected to the connector.

Figure 2:
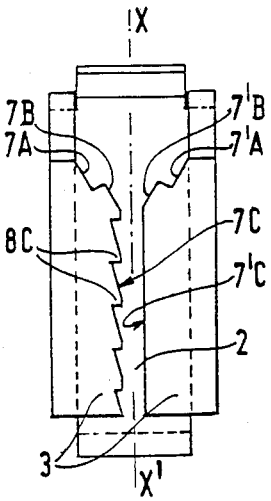
FIGS. 2, 3, and 4 are front views of three variants of the FIG. 1 connector part.
Figure 3:
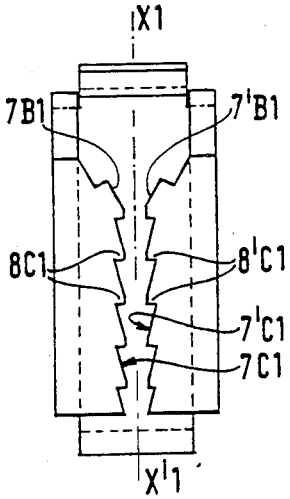
Figure 4:
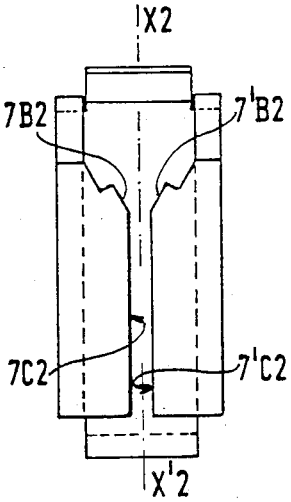

FIGS. 2, 3, and 4 show variant configurations for the slot 2 in the front face 3 of the connector part. FIG. 4 shows a conventional configuration where the clamping strips 7C2 and 7'C2 are rectilinear and parallel to each other, whereas FIGS. 2 and 3 show variants including at least one slot edge having retaining teeth 8 for retaining wires inserted successively into the slot 2. FIG. 2 shows a slot having one rectilinear edge 7'C and one toothed edge 7C having teeth with latching surfaces 8C, while FIG. 3 shows a slot having symmetrically disposed toothed edges 8C1 and 8'C1.

The teeth 8 shown in the above examples are triangular teeth having a camming slope disposed to facilitate insertion and to press the core of a wire being inserted towards the opposite edge of the slot, together with a latching slope extending perpendicularly to the axis XX' and to restrain wire movement in the opposite direction.

In one embodiment of the connector part 1 is made as rigid as possible, as shown in FIG. 1, in order to deform the wire cores instead of separating the sides of the slot, thereby making it possible to insert several wire cores successively into the slot 2 while ensuring that each of them is adequately retained.

In order to do this, the side walls 5 and 6 are preferably relatively short and the metal blank from which the connector part is folded is thicker than would be appropriate for making a wire-stripping slot which relies on the resilience of the connector part. In addition, the part is preferably embedded in a housing having rigid walls which oppose any widening of the slot 2.

The rear wall 4 of the part 1 has a forwardly projecting narrow rim 9 running along its top edge and leaving a transverse cavity 10 opening out into the main body behind the slot 2 and facing said slot. In the embodiment shown, the rim is obtained by folding a relatively narrow margin 9 through more than ninety degrees.

FIG. 1 shows a further optional feature in the form of an additional extension 25 projecting rearwardly from the bottom of the rear wall 4, and serving to provide electrical connection between the connector part and the apparatus in which it is used (not shown) and capable of constituting a connection lug, if necessary.

Figure 5:
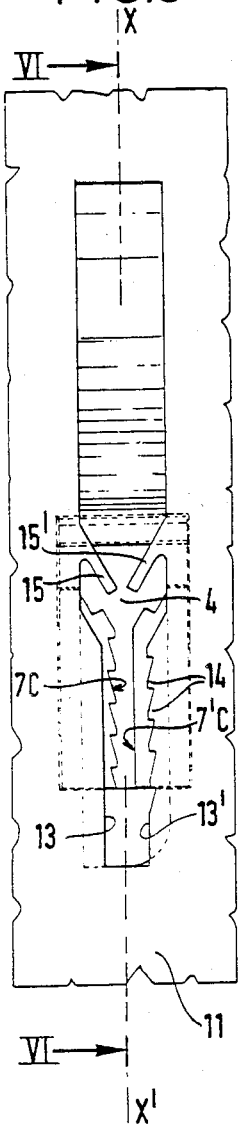
FIGS. 5, 6, and 7 are respectively a partially cut-away front view, a right-hand section view, and a plan section view of a connector in accordance with the invention.
Figure 6:
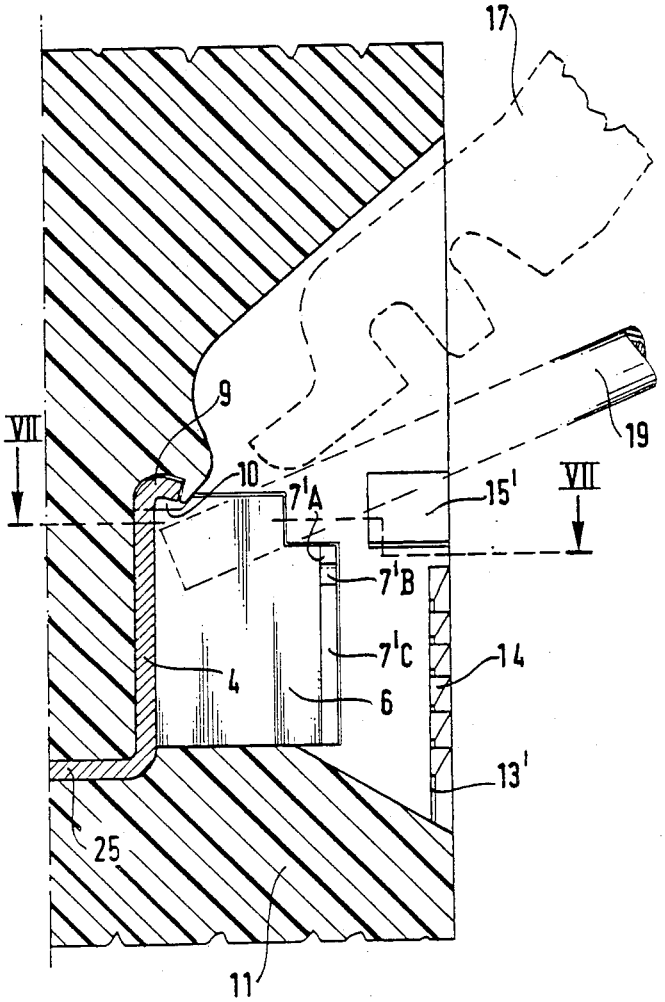
Figure 7:
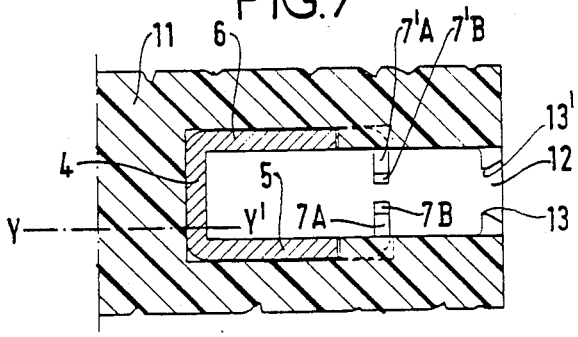

The connector part 1 shown in FIG. 1 is intended to be held fast in a housing in a body of molded insulating material 11 which is shown, in part, in FIGS. 5 to 7.

In order to provide the high degree of rigidity mentioned above, the connector part 1 is preferably held captive inside the body 11 which is often constituted by means of two interfitting parts (as is usually the case for a junction block), with the join line being symbolized in FIG. 7 by dot-dashed line YY'.

The housing for the connector part 1 fits closely around said part, and is open firstly by a passage for the additional extension 25 leading towards the apparatus (not shown here), and secondly by an opening for passing a wire 12 (see FIG. 7) which opening runs along the slot 2.

The opening for passing the wire 12 is laterally delimited by longitudinal edges 13 and 13' made in the body 11. These edges run parallel to the wire insertion axis along the slot 2 and they are separated by a distance less than the outside diameter of the insulation on the wires likely to be connected to the conductor part 1 so as to participate in retaining said wires by clamping to their insulating sheaths.

In a variant embodiment, at least one of the longitudinal edges 13 and 13' is provided with teeth 14 similar to the teeth shown in FIGS. 2 and 3 for the edges of the slot 2, with the teeth 14 (see FIG. 5) being intended to prevent the sheath of a wire that has been inserted from reversing in the direction opposite to the insertion direction.

A wire-retaining device is disposed at the end of the wire-passing opening 12 adjacent to the end by which a wire is inserted into the slot 2. This device is intended to prevent wires, e.g. 19, from moving rearwardly after being inserted and it operates by bearing against the sheath of the last wire to be inserted, should said wire rise above a critical threshold at which it would tend to escape from the clamping provided by the edges of the slot 2 and/or the edges of the opening 12 through which the wire is passed.

In a first embodiment, this retaining device is constituted by at least two projecting fingers 15, 15' provided at the same level above the edges 13, 13' of the wire-passing opening and in the proximity of the inlet slopes to the slot 2 and the wire-passing opening 12. These fingers 15 and 15' are sloped in the wire-insertion direction so as to facilitate insertion of wires into the slot and they are designed to bend under the thrust from a wire being inserted so that they open up during wire insertion. During insertion, wires are disposed transversely relative to the slot and the opening.

However, the free end of each finger is disposed so that once any wire 19 has gone beyond said end during insertion, it is held by its sheath and its core, with its sheath being held between the edges 13 and 13' and with the core being held between the edges of the slot 2. The wire is held captive so long as the force applied therein is not excessive, e.g. so long as it is less than fifteen kilograms-weight.

The width of the finger 15 and 15' may be chosen so as to obstruct the passage between the connection part 1 and the lips 14 and 14', thereby preventing a conductor from being inserted accidentally and avoiding connection with the core of the conductor.

Figure 8:
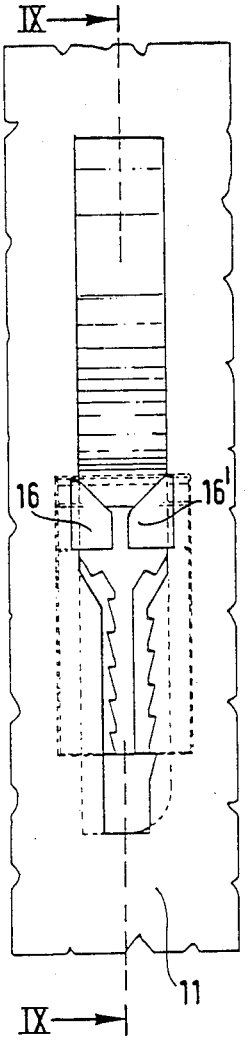
FIGS. 8, 9, and 10 are similar views to FIGS. 5 to 7 showing a variant embodiment of a connector in accordance with the invention.
Figure 9:
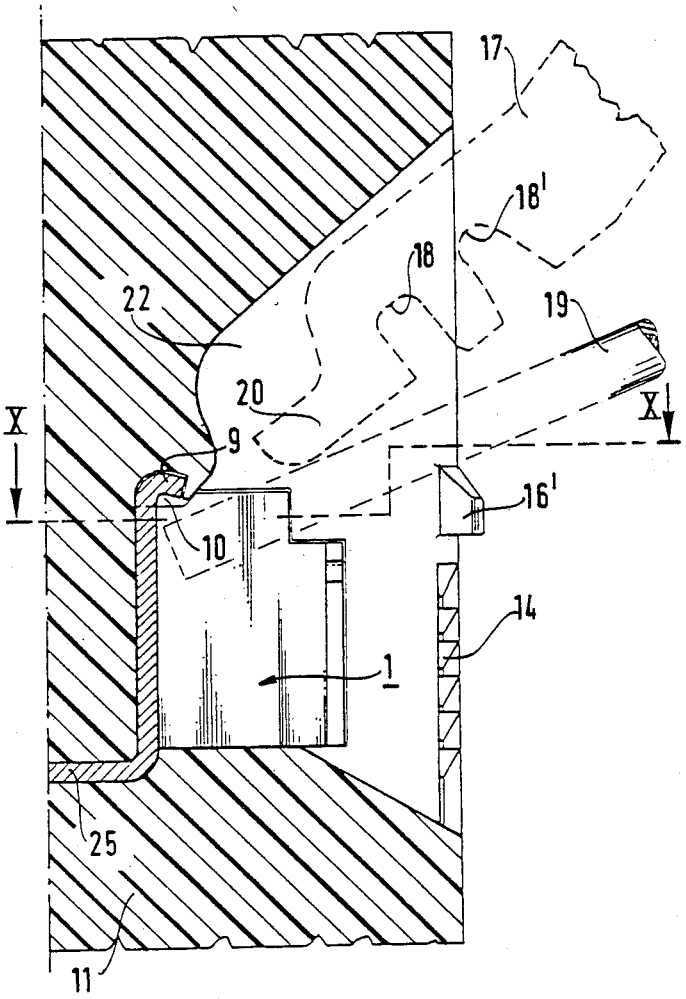
Figure 10:
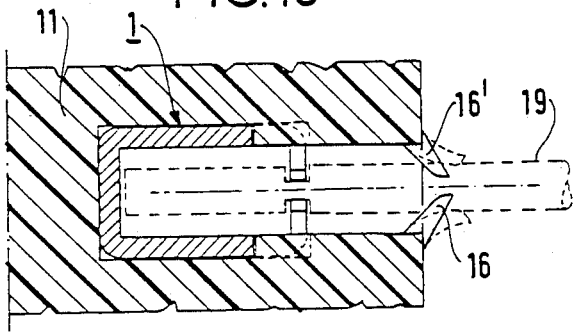
Figure 11:
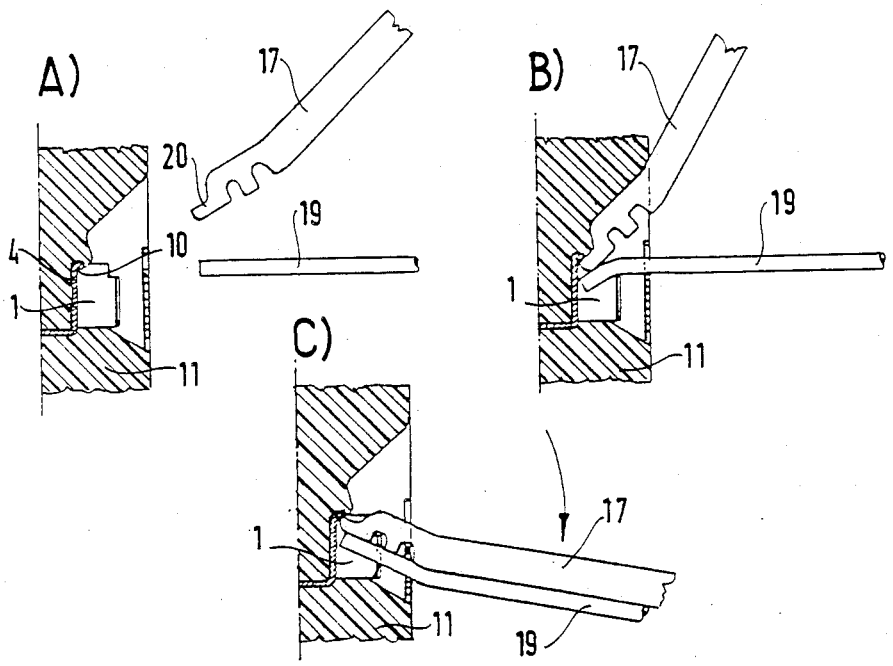
FIGS. 11A, 11B, and 11C are diagrams showing three stages in the process of connecting a wire to a connector in accordance with the invention.
Figure 12:
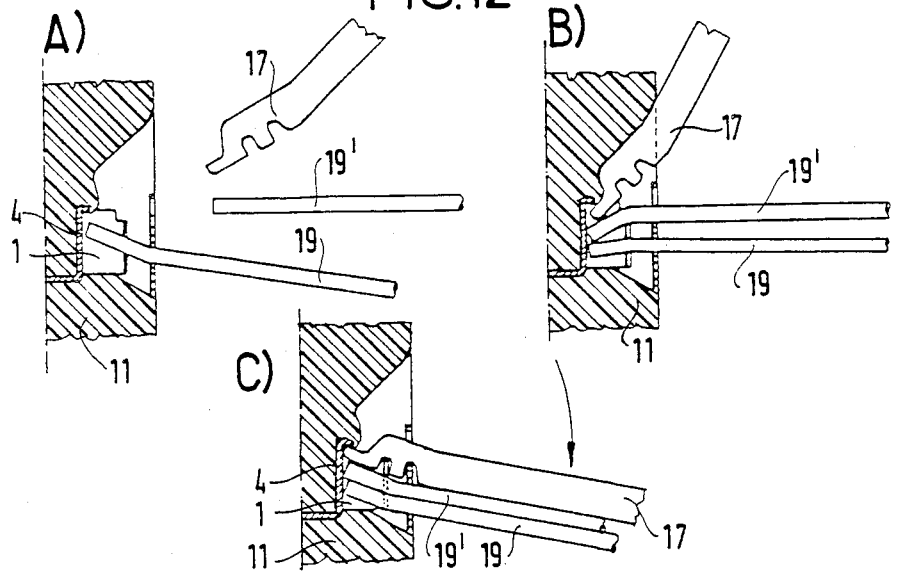
FIGS. 12A, 12B, and 12C are diagrams showing three stages in the process of connecting an additional wire to a connector in accordance with the invention.

In a second embodiment as shown in FIGS. 8 to 10, the retaining device comprises two flaps 16 and 16' disposed at the same level on respective edges of the wire-passing opening 12 in such a manner that the bottoms of said flaps are at the above-defined level for the free ends of the fingers 15 and 15'. The flaps 16 and 16' nearly meet in the longitudinal axis of the wire-passing opening 12, and in the rest position they are nearly closed. They are pushed outwardly from the body 12 during insertion of a wire 19 which is placed transversely relative to the slot 2 and to the wire-passing opening. The flaps are urged forwards by pressure from the sheath of said wire against their sloping top edges. After a wire 19 has been inserted, the flaps 16 and 16' return resiliently to their rest position and then provide an abutment preventing the wire from leaving by moving in the opposite direction to the insertion direction, as before.

A wire 19 is connected to the connector by means of the blade of a tool 17 which is shown partially in FIGS. 6, 9, 11, and 12.

This tool blade is intended to push the wire 19 along the slot 2 and the wire-passing opening 12 until it reaches its final position, and in the example shown, the blade of the tool 17 has two notches 18 and 18' enabling it to press against the inserted wire 19 without itself penetrating into the slot 2 and into the wire-passing opening 12.

One end of the blade of the tool 17 has a handle (not shown) enabling it to be maneuvered, and its opposite end is provided with an end piece 20 for coming into abutment in the transversal cavity 10 in order to bear thereagainst when the tool in used as a lever during wire insertion.

The end piece 20 has a hooking bearing surface at a sharp angle to its top end, thereby enabling it to be locked in the cavity 10 the connector part into a which a wire is to be inserted while pressure is being applied to its handle to thrust a wire into the slot.

In addition, the portion of the blade 17 running between the end piece and the notches is curved relative to the remainder of the blade in order to facilitate using the blade to apply thrust on the wire in the connection zone.

To this end, the body 11 includes a tool-passing opening 22 above the wire-passing opening 12 and consequently on the opposite side of the retaining device from the teeth 14.

This tool-passing opening 22 is made in such a manner as to ensure that the insulating body 11 covers the folded forward margin 9 of the connector part 1 above the transverse cavity 10 so as to provide a reaction to the wire-insertion forces. It serves to insert the end piece into the transverse cavity 10 when a wire 19 is waiting to be inserted, as shown in the above-mentioned figures, and it also enables the tool blade to move along the axis of the slot 2 until the wire has been pushed home to the bottom of the slot.

FIGS. 11A, 11B, and 11C show three stages during wire connection. Prior to connection, the connector part 1 is embedded on its own in the body 11 and a non-stripped wire is inserted therein until its leading end abuts against the rear wall of the connector part 1. The tool blade 17 is then inserted in a preparatory position (in this case upwardly directed) with its end piece 20 located in the transverse cavity 10 of the connector part 1.

The tool blade is then used as a lever. By applying a force (in this case a downwardly directed force) on the tool handle, the blade is caused to pivot about a fixed abutment point constituted by the transverse cavity 10 and the end piece 20. The core of the wire 19 is thrust into the slot 2 and is deformed therein while the sheath of said wire is simultaneously thrust into the wire-passing opening 12 and is, in addition, sliced through by the sloping portions located at the inlet to the slot 2. Once the wire has been pushed fully home, the tool may be removed, optionally temporarily prior to inserting a second wire, as shown in FIGS. 12A to 12C.

A new wire 19' is then placed ready for insertion in the above-described manner with its non-stripped leading end in abutment against the rear wall 4 of the connector part 1 and extending substantially orthogonally above the slot 2 and the wire-passing opening 12. The bearing end piece 20 of the tool blade is placed in the cavity, as before, and pressure is again applied on the tool so that it presses down in its intermediate zone against the sheath of the wire 19' thereby thrusting the wire into the slot and the wire-passing opening until it comes into contact with the previously installed wire 19. The tool is then removed again and may, optionally, be used to insert a further wire into the connector part 1. The tool blade 17 can also be used to thrust the last-inserted wire past the obstacle constituted by the retaining device, should it be necessary to remove the wire, by pressing the sheath of the wire to be removed against the tool blade which is placed in the retaining device in order to separate the fingers or flaps thereof.

Figure 13:
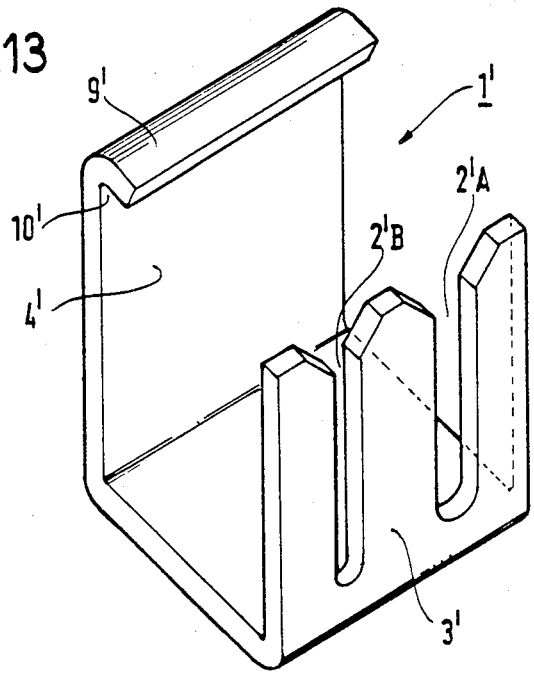
FIGS. 13 and 14 are diagrammatic perspective views of two further variants of connector parts in accordance with the invention.

In a variant embodiment, a connector part in accordance with the invention may include more than one slot, for example the connector part 1' shown in FIG. 13 comprises two longitudinally extending core-clamping slots 2'A and 2'B, thereby enabling the height of the part to be reduced, at the expense of increasing its width, supposing that more than one conductor wire 13 is to be connected thereto. The transverse cavity 10 for providing an abutment for a tool blade is then common to both slots 2'A and 2'B which are preferably associated with respective distinct wire-passing openings through the insulating body (not shown).

The slots 2'A and 2'B may optionally be of different sizes, for example, one may be wider than the other as shown in FIG. 13, thereby enabling wires of greatly different diameters to be connected together.

Figure 14:
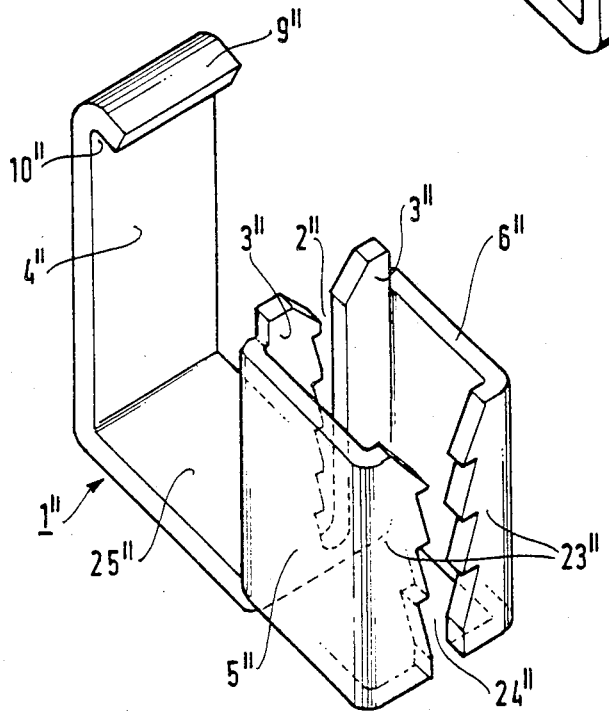

Another variant embodiment is shown in FIG. 14 in which the connector part includes an additional slot for clamping the sheath 23 in addition to the slot for clamping the core, for example in order to ensure greater rigidity.

The connector part 1'' is received in the insulating body in an entirely similar manner to the connector part 1, as shown in FIGS. 8, 9, and 10, and thus includes a wire-passing opening, preferably without any retaining teeth, together with a tool-passing opening.

The connector part 1″ is itself obtained by folding a metal blank, and it comprises a body of rectangular section provided with a core clamping slot 2″ in one of its walls 3″ in a manner which is completely identical with that described above for the connector part 1.

The outside edges of the wall 3″ have side pieces 5″ and 6″ projecting therefrom and the ends of these side pieces are folded perpendicularly towards each other to form a front wall 23″, with the non-touching edges of these folded ends forming a longitudinal slot 24″ in the front wall 23″.

As already mentioned above, the slots 2″ and 24″ are delimited by edges which which may be smooth or toothed as for the range of embodiments shown in FIGS. 2 to 4, with the teeth serving to retain either the cores or else the sheaths of conductor wires connected thereto.

The width and the shape of the slot 24″ is designed to clamp onto the insulating sheaths of the wires fixed thereto and is thus located between the core-clamping slot 2″ and the wire-passing opening through the body of insulating material in which the connector part 1″ is received.

The rectangular section body including the slots 2″ and 24″ extends rearwardly from the wall 3″ away from the front wall 23″. The resulting extension 25″ is situated, for example, opposite the end via which a wire is inserted into the slot 2″ and is itself extended by a perpendicular fold forming a back wall 4″ and having a rim 9″ which defines a transverse cavity 10″ against which the end of a tool blade bears during wire insertion into the slots, in the manner described above.

Connection tabs or other connection means can readily be provided in known manner in one or other of the walls of any of the above-described connector parts 1, 1′, or 1″ for electrical connection to electrical apparatus. Such connection may be by means of a conventional spade-type connector, by soldering, or by crimping.

What is claimed is:

1. In a wire-stripping connector for connection to at least one electric wire having a conductive core disposed in an insulating sheath by use of a tool having a blade forming a lever terminating at one end in a bearing end piece and having an intermediate zone, said connector comprising a metal connector part having a wall including at least one longitudinal core-clamping slot of elongate shape and opening out at one end to enable the wire to be inserted between the edges of the slot, said slot edges being arranged at said insertion end for cutting through the insulation without knicking the core, said connector part being fixedly restrained in a housing in a body of insulating material having a wire-passing opening therethrough running along the slot, said connector including the improvement wherein said connector part includes means forming a transverse cavity located behind the slot in said housing and open towards the slot such as to serve as a fixed bearing point for said bearing end piece provided at one end of said blade of said tool for use as a lever to thrust said wire into said slot, with said tool blade intermediate zone engaging said wire in the vicinity of the slot and for urging said wire substantially orthogonally into the slot and into the wire-passing opening when an external insertion thrust is exerted in the slot direction at the opposite end of the tool blade, and the body of insulating material covering the connection part around said cavity to reinforce the cavity forming means to enable it to withstand pressure from the too blade while a wire is being inserted in the slot.

2. A wire-stripping connector according to claim 1, wherein the body wire-passing opening includes means for holding the wire by clamping the insulation thereof between the edges of said opening, and wherein one of the body wire-passing opening and metal connector part slot have opposed longitudinal edges and are provided with retaining teeth on at least one of their longitudinal edges in a clamping zone.

3. A connector according to claim 1, wherein the body at said wire-passing opening includes a wire-retaining device at least at the level at which the end of the wire is inserted into the slot, in order to prevent a wire from reversing back out from the metal connector part slot after being inserted therein.

4. A connector according to claim 3, wherein the wire-retaining device is constituted by at least two fingers provided at the same level on the edges of the body wire-passing opening on either side of said opening, said fingers being inclined in the insertion direction so as to enable them to be flexed by the insertion of a wire which extends transversely relative to the wire-passing opening and which is thrust along the longitudinal edges of said opening in the insertion direction, and to oppose any displacement of the wire in the opposite direction after it makes contact with the ends of the fingers.

5. A connector according to claim 3, wherein said wire-retaining device body is constituted by two flaps provided at the same level on either side of the wire-passing opening and coming nearly into contact with each other, said flaps being capable of being pushed outwardly apart from each other by a wire extending transversely to the body wire-passing opening and being thrust in the insertion direction along the longitudinal edges of the opening, by virtue of the flaps having edges sloping in said direction, said flaps preventing displacement of the wire in the opposite direction once it comes into abutment thereagainst.

6. A connector according to claim 1, wherein the connector part is made by folding a pre-cut blank, and comprises a main body of rectangular section having a wall including at least one core-clamping slot and having a parallel opposite wall including said transverse cavity, said cavity being defined by an inwardly folding rim portion of the connection part situated at the same end of the connection part as the wire insertion end to the slot.

7. A connector according to claim 6, wherein the connector part includes at least two parallel core-clamping slots of sizes suitable for clamping to wires having substantially different core diameters.

8. A connector according to claim 1, wherein the connector part is made by folding a pre-cut blank, and comprises a main body of rectangular section including a core-clamping slot in one of its walls and an auxiliary sheath-clamping slot running parallel to the core-clamping slot in a wall which is parallel to and in front of the wall in which the core-clamping slot is provided, and wherein the transverse cavity is defined by an inwardly folding rim at the end of a rearward extension to the main body, said extension being folded and extending parallel to said walls having slots therein and wherein the wall including the core-clamping slot being the middle wall.

9. A connector according to claim 1, wherein the connector part is embedded in the body of insulating material, which insulating material body is constituted by at least two separable parts enabling said connector part to be inserted therein, the wire-passing opening which runs along the slot and extending above the slot, is in the form of a tool blade passing opening which leads to the transverse cavity of the connection part and which serves as a fixed bearing with said cavity level therewith for cooperating with a bearing end piece at the end of the tool blade.

* * * * *